US005797157A

United States Patent [19]

Gregg

[11] Patent Number: 5,797,157

[45] Date of Patent: Aug. 25, 1998

[54] BATTERY POWERED BALANCED FLOOR BUFFER

[76] Inventor: James R. Gregg, 16458 Bolsa Chica Rd., #184, Huntington Beach, Calif. 92649

[21] Appl. No.: 736,121

[22] Filed: Oct. 24, 1996

[51] Int. Cl.[6] ..... A47L 11/282

[52] U.S. Cl. ..... 15/49.1; 15/22.1; 15/28

[58] Field of Search ..... 15/22.1, 28, 49.1, 15/98, 410, 50.1

[56] References Cited

U.S. PATENT DOCUMENTS

| | | | |
|---|---|---|---|
| D. 317,667 | 6/1991 | Bolser | 15/28 |
| 3,195,537 | 7/1965 | Blasi | 15/28 |
| 4,404,706 | 9/1983 | Loyd | 15/410 |
| 4,823,514 | 4/1989 | DeLuca | 15/22.1 |
| 4,829,719 | 5/1989 | Braselton | 15/22.1 |
| 5,511,269 | 4/1996 | Watson | 15/28 |

FOREIGN PATENT DOCUMENTS

| | | | |
|---|---|---|---|
| 2011227 | 9/1971 | Germany | 15/28 |
| 3341465 | 5/1985 | Germany | 15/28 |
| 3628073 | 2/1988 | Germany | 15/28 |
| 3911759 | 11/1989 | Germany | 15/28 |
| 0123564 | 10/1978 | Japan | 15/28 |
| 4085456 | 5/1992 | Japan | 15/98 |
| 2249022 | 4/1992 | United Kingdom | 15/28 |

*Primary Examiner*—Randall Chin

[57] ABSTRACT

A floor buffer having the power source and drive means mounted at one end of an elongate handle, and a buffer head mounted at the other end, such that the center of gravity of the machine is roughly at the midpoint of the elongate handle, and having a carrier strap, hand grip and switch mounted on the handle between the midpoint of the handle and the power source and drive motor such when in use and carried by the user the buffer head rests lightly and controllably on the floor is disclosed.

3 Claims, 2 Drawing Sheets

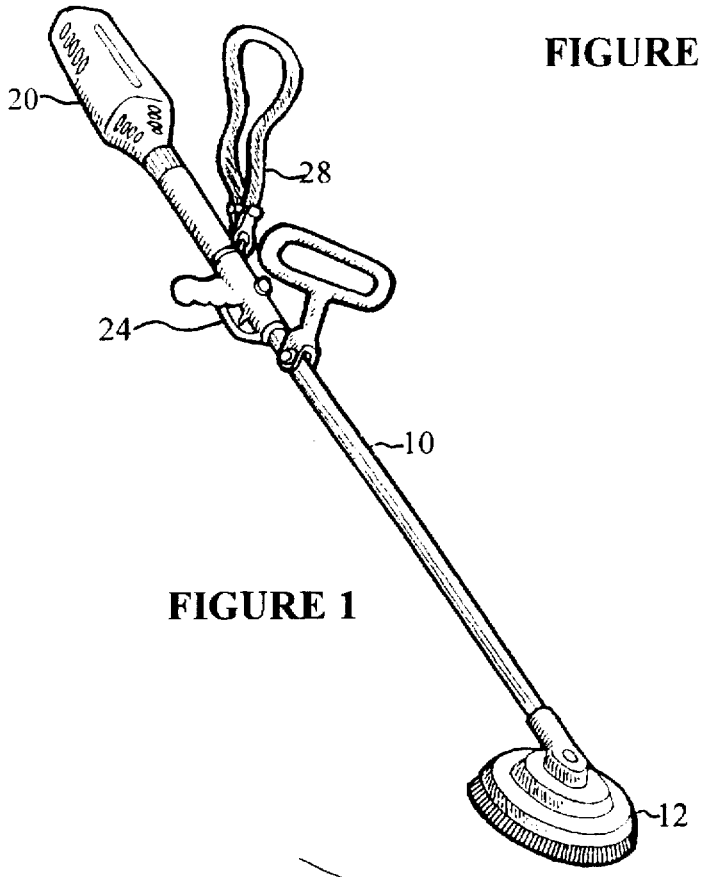
FIGURE 1
FIGURE 2
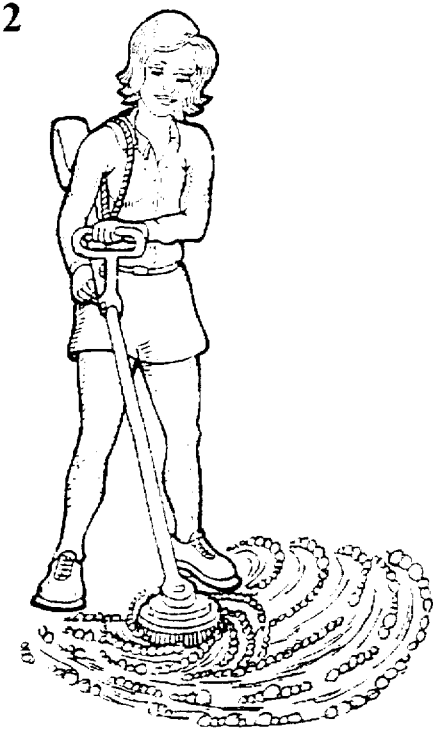
FIGURE 3
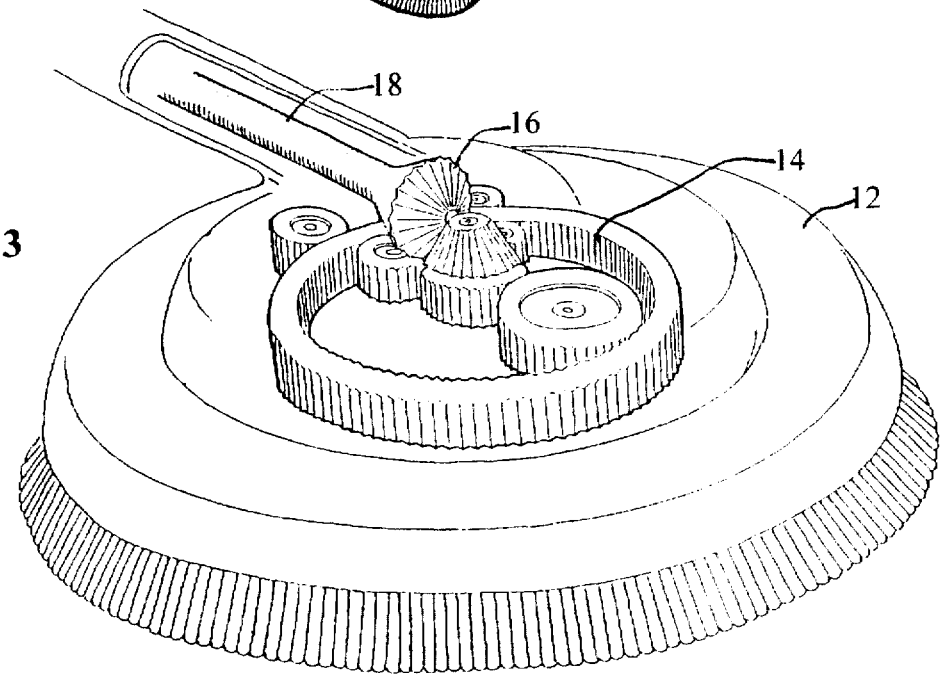

BATTERY POWERED BALANCED FLOOR BUFFER

FIELD OF THE INVENTION

This invention relates to household floor cleaning and polishing appliances.

BACKGROUND OF THE INVENTION

The floor scrubbing and polishing machine art is crowded by a very large number of machines for buffing, polishing and scrubbing floors. Most of these machines are useful only in institutions and industry. A few such machines which are basically smaller models of industrial buffers can be used in the home.

There are several reasons why floor buffers have not become a common household appliance, but the fundamental reason is that all prior art devices are so difficult for an untrained operator or a home maker to use that they are used only on special projects where no reasonable alternative is available. Another important reason why home makers do no use floor buffers is that the prior art devices are not readily portable because of the weight of the machine and the need for heavy electric cords.

Prior art buffers generally comprise a disk-like housing upon which is mounted a motor and brush mount to which a circular brush can be attached. In the institutional or industrial environment, and where there are large expanses of flooring, this type of machine is generally well-suited. The motor weighs down the brush and enhances scrubbing. This is important where very heavy duty scrubbing or buffing is desired. This type of machine, whatever its size, suffers from a very severe disadvantage in that it is very difficult to control. The torque of the motor must be overcome by the strength of the operator. For a small or inexperienced operator simply turning on one of these machines can be a daunting experience. With some training and experience, one can learn to control these prior art machines, but they are never entirely suitable for home use.

There are, of course, hand held buffers, etc., but to the best of the inventor's knowledge, none of them feature the handle mounting arrangement wherein the motor is on one end of an elongate handle and the buffer is on the other end of the handle.

It is the object of this invention to provide a floor buffer machine that is light, entirely portable, easy to use and inexpensive to manufacture.

SUMMARY OF THE INVENTION

The present invention comprises a floor buffer/scrubber machine wherein the power source and drive means are mounted at one end of an elongate handle and the buffer head is located at the other end of the handle such that the center of gravity of the machine is roughly at the midpoint of the elongate handle. A carrier strap, hand grip and switch are mounted on the handle between the midpoint of the handle and the power source and drive motor, such when in use and carried by the user the buffer head rests lightly and controllably on the floor. The machine is light, entirely portable, easily controllable, conveniently useable and can be manufactured and sold at a cost that is within the reach of most households.

BRIEF DESCRIPTION OF THE DRAWINGS

FIG. 1 depicts the machine of this invention in a perspective view.

FIG. 2 depicts the machine of this invention in use by a home maker.

FIG. 3 shows one example of gearing that can be used to drive the buffer.

FIGS. 4, 5, 6, and 7, depict various forms of buffer heads than can be provided, wherein FIGS. 4 and 5 depict a three-buffer head, FIG. 6 depicts a single soft buffer head and FIG. 7 depicts a double soft buffer head.

DESCRIPTION OF THE PREFERRED EMBODIMENTS

Figure 4:
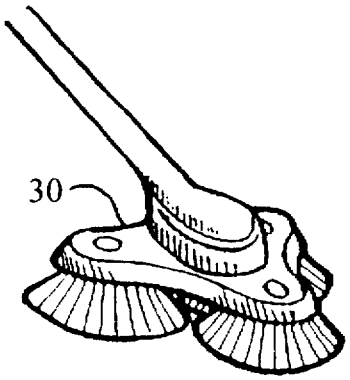

The drawings and description set forth the best mode presently known to the inventor for making and using the invention and do not limit the scope of the invention. In particular, any of a virtually infinite variety of gearing systems may be used to drive the buffer head.

The buffer/scrubber machine of this invention comprises an elongate tubular handle 10 having a buffer head 12 mounted on the distal end thereof and a housing 20 containing battery power pack and motor mounted on the proximal end thereof. The power pack comprises one or more rechargeable batteries. Many types of such batteries are now available and are used in portable drills, etc. The motor is a conventional electric drive motor.

The buffer head comprises a disk-like housing 12, or a housing constructed and adapted to receive plural buffer brushes. Mounted in the housing in a configuration to drive the buffer brush(es) is a gear system 14. Any of a great variety of gear systems can be used, the system depicted being merely exemplary.

The gear system 14 is driven by a gear 16 mounted on or formed on the end of shaft 18. Shaft 18 extends through the tubular handle 10 and is rotatably driven by the motor in the power pack and motor 20. Suitable bearings may be provided for the shaft, gears, buffer brush mounts, etc., as is commonly done in electric appliances.

Mounted on the distal portion of the tubular handle, between the midpoint of the handle and the power pack and motor 20, is a switch mechanism 24 which is preferably a pistol grip and trigger assembly, so as to permit the user to control the movement of the handle and turn the machine on and off as desired. The switch is electrically connected to make and break a circuit between the battery pack and motor in the conventional manner. A hand grip 26 is mounted distally from the switch mechanism to permit control of the movement of the buffer head and to apply a downward force to the buffer head. A carrier strap 28 is mounted to the elongate handle proximal of the switch mechanism for carrying the weight of the power pack and motor and part of the weight of the handle and shaft on the user's shoulder.

The arrangement of these components on the handle, the shoulder carrier strap 28 proximal of the switch 24 and the hand grip 26 distal of the switch, the switch mechanism being a pistol grip and trigger, permits total control by the user, allowing the user to move the buffer head at will and to apply as much or as little downward force on the buffer head as desired. This degree and type of control is not available in any floor buffer/scrubber heretofore known.

Figure 5:
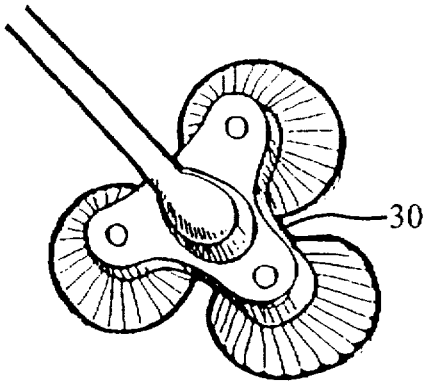

Generally, a single buffer head 12 constructed and configured, using the techniques and fittings well-known in the art, to permit interchangeable buffer brushes, scrubbers, polishers, etc., is adequate for most households. However, a triple head buffer such as shown in FIGS. 4 and 5 may be used.

Figure 6:
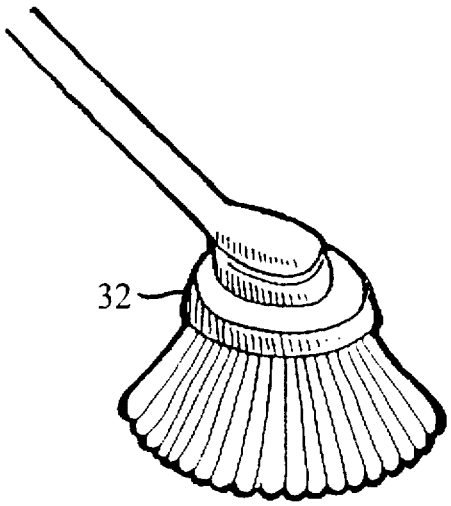

The use of a soft buffer is shown in FIG. 6. This may be the same head as shown in FIG. 3, with a soft buffer disk attached, or a specially built buffer head.

Figure 7:
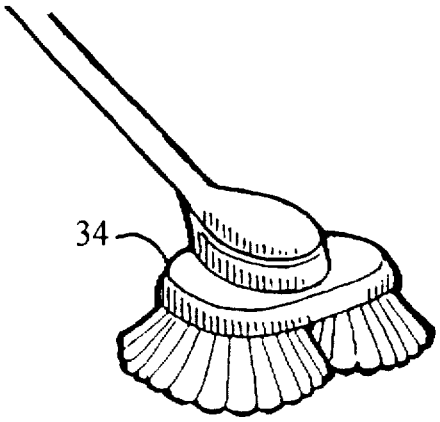

A double head soft buffer head arrangement is shown in FIG. 7.

In a preferred embodiment, the invention is embodied in a household floor buffer machine that comprises the combination generally as shown in the figures. The buffer is constructed on an elongate tubular handle 10 having a proximal end, a midpoint and a distal end. A battery power pack and an electric motor housing 20 is mounted on the proximal end of the elongate tubular handle 10 and a battery power pack and an electric motor driven by the power pack are mounted in the housing 20. An elongate shaft 18 rotatably driven by the electric motor extends through the elongate tubular handle and has a drive gear 16 on the distal end of the shaft. A buffer head 12 for mounting at least one buffer brush is mounted on the distal end of the elongate tubular handle 10. Gearing 14 driven by the drive gear 16 on the shaft is mounted in the buffer head. 12 The drive gear, gearing and buffer head are constructed and configured to drive at least one buffer brush. In a most preferred embodiment, a pistol grip and trigger electric switch mechanism 24 for turning the electric motor on and off is mounted on the elongate tubular handle spaced distally from battery power pack and electric motor housing 20 between said battery power pack and electric motor housing and the midpoint of the elongate tubular handle 10. A shoulder carrying strap 28 is secured to the elongate tubular handle between the electric switch 24 and the power pack and motor housing 20. A hand grip 26 is mounted on the elongate tubular handle between the electric switch 24 and the midpoint of the elongate tubular handle 10.

It will be understood from these examples that the precise structure of the buffer head is not a critical facet of the invention.

As pointed out, the buffer art is crowded. The basic technology is nearly a century old and many variations and improvements have been made. While there may be little room for revolutionary progress, there remain long felt needs which have not been met. This invention fills one of these needs in a unique and particularly advantageous way.

INDUSTRIAL APPLICATION

This invention is useful in the household appliance industry.

What is claimed is:

1. A household floor buffer machine comprising, in combination:

an elongate tubular handle having a proximal end, a midpoint and a distal end;

a power pack and motor housing mounted on the proximal end of the elongate tubular handle;

a battery power pack and an electric motor driven by the power pack mounted in the housing;

an elongate shaft rotatably driven by the electric motor extending through the elongate tubular handle;

a drive gear on the distal end of the shaft;

a buffer head mounted on the distal end of the elongate tubular handle for receiving at least one buffer brush;

gearing mounted in the buffer head driven by the drive gear on the shaft, the buffer head, gearing and drive gear being constructed and configured to drive at least one buffer brush;

an electric switch for turning the electric motor on and off mounted on the elongate tubular handle spaced distally from the power pack and motor housing between the power pack and motor housing and the midpoint of said elongate tubular handle; and a hand grip mounted on the elongate tubular handle between the electric switch and the midpoint of said elongate tubular handle.

2. A household floor buffer machine comprising, in combination:

an elongate tubular handle having a proximal end, a midpoint and a distal end;

a power pack and motor housing mounted on the proximal end of the elongate tubular handle;

a battery power pack and an electric motor driven by the power pack mounted in the housing;

an elongate shaft rotatably driven by the electric motor extending through the elongate tubular handle;

a drive gear on the distal end of the shaft;

a buffer head mounted on the distal end of the elongate tubular handle for receiving at least one buffer brush;

gearing in the buffer head driven by the drive gear on the shaft, said buffer head, gearing and drive gear being constructed and configured to drive at least one buffer brush;

an electric switch for turning the electric motor on and off mounted on the elongate tubular handle spaced distally from the power pack and motor housing between the power pack and motor housing and the midpoint of said elongate tubular handle;

a shoulder carrying strap secured to the elongate tubular handle between the electric switch and the power pack and motor housing; and a hand grip mounted on the elongate tubular handle between the electric switch and the midpoint of the elongate tubular handle.

3. A household floor buffer machine comprising, in combination:

an elongate tubular handle having a proximal end, a midpoint and a distal end;

a battery power pack and electric motor housing mounted on the proximal end of the elongate tubular handle;

a battery power pack and an electric motor driven by the power pack mounted in the housing;

an elongate shaft rotatably driven by the electric motor extending through the elongate tubular handle;

a drive gear on the distal end of the shaft;

a buffer head for mounting at least one buffer brush mounted on the distal end of the elongate tubular handle;

gearing in the buffer head driven by the drive gear on the shaft, said buffer head, gearing and drive gear being constructed and configured to drive at least one buffer brush;

a pistol grip and trigger electric switch mechanism for turning the electric motor on and off mounted on the elongate tubular handle spaced distally from the battery power pack and electric motor housing between said battery power pack and electric motor housing and the midpoint of the elongate tubular handle;

a shoulder carrying strap secured to the elongate tubular handle between the electric switch and the power pack and motor housing; and a hand grip mounted on the elongate tubular handle between the electric switch and the midpoint of the elongate tubular handle.

* * * * *